US010768570B2

(12) United States Patent
Suenaga et al.

(10) Patent No.: US 10,768,570 B2
(45) Date of Patent: Sep. 8, 2020

(54) IMAGE FORMING APPARATUS PROVIDED WITH RECOVERY CONTAINER FOR WASTE TONER

(71) Applicant: KONICA MINOLTA, INC., Chiyoda-ku Tokyo (JP)

(72) Inventors: Takenori Suenaga, Hachioji (JP); Ryo Goto, Toyokawashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/926,277

(22) Filed: Mar. 20, 2018

(65) Prior Publication Data

US 2018/0275599 A1 Sep. 27, 2018

(30) Foreign Application Priority Data

Mar. 21, 2017 (JP) ..... 2017-053933

(51) Int. Cl.

| | |
|---|---|
| ***G03G 21/10*** | (2006.01) |
| ***G03G 21/12*** | (2006.01) |
| ***G03G 21/00*** | (2006.01) |
| ***G03G 15/095*** | (2006.01) |
| ***G03G 15/08*** | (2006.01) |

(52) U.S. Cl.

CPC ..... *G03G 21/12* (2013.01); *G03G 15/0808* (2013.01); *G03G 15/0856* (2013.01); *G03G 15/095* (2013.01); *G03G 21/0011* (2013.01); *G03G 21/10* (2013.01); *G03G 21/105* (2013.01); *G03G 2215/0888* (2013.01); *G03G 2221/1624* (2013.01)

(58) Field of Classification Search

CPC ..... G03G 21/12; G03G 15/0856; G03G 15/0808; G03G 15/095; G03G 21/0011; G03G 21/105; G03G 2215/0888; G03G 2221/1624; G03G 21/10; G03G 15/553

See application file for complete search history.

(56) References Cited

U.S. PATENT DOCUMENTS

2004/0052560 A1* 3/2004 Ishii ..... G03G 21/12 399/360
2009/0067856 A1* 3/2009 Ito ..... G03G 21/12 399/34

(Continued)

FOREIGN PATENT DOCUMENTS

JP 2013242402 A 12/2013
JP 2016194729 A 11/2016

*Primary Examiner* — Walter L Lindsay, Jr.
*Assistant Examiner* — Laura Roth
(74) *Attorney, Agent, or Firm* — Cantor Colburn LLP

(57) ABSTRACT

An image forming apparatus includes an image forming unit for forming an image on a sheet and a sheet conveying unit for conveying the sheet along a conveying path extending in a substantially horizontal direction in a lower portion of the image forming unit. The image forming apparatus includes a recovery container which is provided in front of the image forming unit and above the conveying path, and accommodates the waste toner discharged from the image forming unit. The image forming apparatus includes a waste toner conveying pipe that conveys the waste toner discharged from the image forming unit to the recovery container, without passing through the rear portion and the side portion of the image forming unit.

10 Claims, 10 Drawing Sheets

(56) References Cited

U.S. PATENT DOCUMENTS

| | | | | |
|---|---|---|---|---|
| 2011/0206433 | A1* | 8/2011 | Gayne | G03G 21/105 399/358 |
| 2013/0183050 | A1* | 7/2013 | Kwon | G03G 21/12 399/35 |
| 2013/0243444 | A1* | 9/2013 | Karasawa | G03G 21/1671 399/13 |
| 2014/0044465 | A1* | 2/2014 | Mekada | G03G 21/105 399/358 |

* cited by examiner

IMAGE FORMING APPARATUS PROVIDED WITH RECOVERY CONTAINER FOR WASTE TONER

CROSS-REFERENCE TO RELATED APPLICATIONS

The present invention claims priority under 35 U.S.C. § 119 to Japanese patent application No. 2017-053933 filed on Mar. 21, 2017, the entire disclosure of which are incorporated herein by reference.

BACKGROUND

Technological Field

The present invention relates to an image forming apparatus. More specifically, the present invention relates to an image forming apparatus provided with a recovery container for collecting waste toner.

Description of the Related Art

As an electrophotographic image forming apparatus, there is an MFP (Multi Function Peripheral) having a scanner function, a facsimile function, a copying function, a function as a printer, a data communication function, and a server function. As an electrophotographic image forming apparatus, there are a facsimile apparatus, a copying machine, a printer, and the like.

Generally, an image forming apparatus forms a toner image by developing an electrostatic latent image formed on a photosensitive member with a developing device. The image forming apparatus transfers the toner image to the sheet, and then fixes the toner image on the sheet by the fixing device. As a result, the image forming apparatus forms an image on the paper. Some image forming apparatuses form a toner image by developing the electrostatic latent image on the surface of the photosensitive member using a developing device, and transfer the toner image to an intermediate transfer belt by using a primary transfer roller. The image forming apparatus secondarily transfers the toner image on the intermediate transfer belt to the paper using a secondary transfer roller. In this case, the photosensitive member and the intermediate transfer belt serve as image bearing members. Toner which was not used for development in the developing device or toner which was not transferred but remains on the photosensitive member or on the intermediate transfer belt is collected into the recovery container as waste toner.

Among conventional image forming apparatuses, there are various positional relationships between an image forming unit including a photosensitive member and a developing device, and a conveying path for conveying a sheet. As an example, there are an image forming apparatus having a vertical conveying path on the side of the image forming unit, and an image forming apparatus having a conveying path in a substantially horizontal direction on the underside of the image forming unit.

Among them, an image forming apparatus having a substantially horizontal conveying path on the underside of the image forming unit has an advantage that the space under the image forming unit can be used as a conveying path, being compared to an image forming apparatus having a vertical conveying path on the side of the image forming unit.

Conventional techniques related to waste toner recovery containers are disclosed in, for example, the below Documents 1 and 2.

The documents 1 and 2 below disclose a waste toner recovery container. The waste toner recovery container has an introduction port for accepting the waste toner discharged from the image forming unit that forms an image on the sheet. The waste toner recovery container has a waste toner accommodating chamber for accommodating the waste toner received from the introduction port. The waste toner recovery container is provided with an auger which receives driving power and transports the waste toner accommodated in the waste toner accommodating chamber while rotating. The waste toner recovery container includes a main body unit which is provided in a movement path of the waste toner moving from the introduction port to the waste toner accommodating chamber and vibrates by contacting the auger. The waste toner recovery container includes a breaking member having a sticking portion which is continuous with the main body unit and is fixed while being separated from the moving path of the waste toner.

DOCUMENT(S)

Document(s) Related to Patent(s)

[Document 1] Japanese Unexamined Patent Publication No. 2013-242402

[Document 2] Japanese Unexamined Patent Publication No. 2016-194729

In an image forming apparatus having a substantially horizontal conveying path on the underside of the image forming unit, the space secured in front of the image forming unit and the conveying path is narrow. This is because it is necessary to guarantee the operability when a jam recovery operation is performed by enabling the user to access the conveying path immediately from the front of the image forming apparatus, when a jam occurs in the conveying path.

In view of the above circumstances, in this type of conventional image forming apparatus, the waste toner caused in the image forming unit has once been conveyed to the rear portion of the image forming unit. Thereafter, the waste toner was conveyed to a recovery container provided at a side portion or a front portion of the image forming unit. As a result, the conveying path of the waste toner becomes longer, and the space for arranging the waste toner conveying path becomes larger, which hinders further downsizing of the image forming apparatus.

SUMMARY

The present invention has been made to solve the above-described problems, and an object thereof is to provide an image forming apparatus capable of downsizing.

To achieve at least one of the abovementioned objects, according to an aspect of the present invention, an image forming apparatus reflecting one aspect of the present invention comprises: an image forming unit that forms an image on a sheet, a sheet conveying unit configured to convey a sheet along a conveying path extending in a substantially horizontal direction in a lower portion of the image forming unit, a recovery container that is provided in front of the image forming unit and above the conveying path, and that stores waste toner discharged from the image forming unit, and a waste toner conveying pipe that conveys the waste toner discharged from the image forming unit to the recovery container, without passing through a rear portion and a side portion of the image forming unit.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
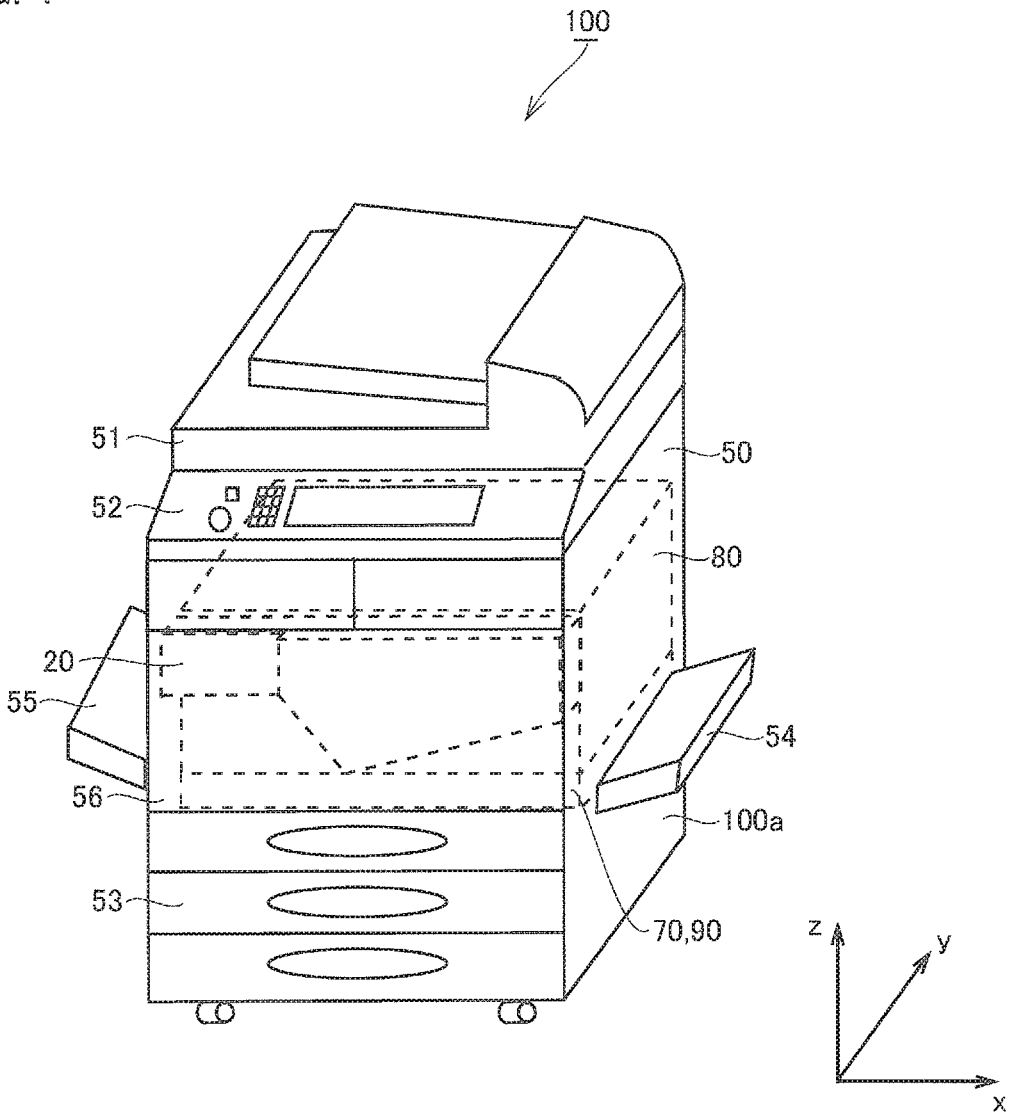
FIG. 1 is a perspective view showing a configuration of an image forming apparatus 100, according to an embodiment of the present invention.

Hereinafter, one or more embodiments of the present invention will be described with reference to the drawings. However, the scope of the invention is not limited to the disclosed embodiments.

In the present embodiment, the case where the image forming apparatus is an MFP will be described. The image forming apparatus may be a MFP, a facsimile machine, a copying machine, a printer, or the like.

In the drawings, the direction from the front surface to the rear surface of the image forming apparatus is defined as the positive direction of the y axis. The direction from the left side to the right side of the image forming apparatus when the image forming apparatus is viewed from the front is the positive direction of the x axis. The direction from the lower side to the upper side of the image forming apparatus along the vertical direction is the positive direction of the z axis. The x, y, and z axes shall be orthogonal to each other.

In the following description, the left side of the image forming apparatus viewed from the front of the image forming apparatus may be referred to as "left". The right side of the image forming apparatus viewed from the front of the image forming apparatus may be referred to as "right".

First, the configuration of the entire image forming apparatus according to the present embodiment will be described.

FIG. 1 is a perspective view showing a configuration of an image forming apparatus 100, according to an embodiment of the present invention.

Referring to FIG. 1, image forming apparatus 100 in the present embodiment mainly includes recovery container 20, control unit 50, scanner unit 51, an operation panel 52, a sheet feed cassette 53, a manual feed tray 54, a paper discharge tray 55, a sheet conveying unit 70, an image forming unit 80, a fixing device 90, and the like.

The control unit 50 controls the entire image forming apparatus 100. The control unit 50 includes a CPU (Central Processing Unit), a ROM (Read Only Memory), a RAM (Random Access Memory), a HDD (Hard Disk Drive), and the like.

The scanner unit 51 reads an image of a document, and is provided at the uppermost part of the image forming apparatus 100.

The operation panel 52 receives various operations and performs various displays, and is provided in front of the scanner unit 51 and on the front of the image forming apparatus 100.

The sheet feed cassette 53 is a portion for storing sheets, and is provided at the lowermost part of the image forming apparatus 100. The number of sheet feed cassettes 53 is arbitrary, and it is plural (three stages) in the embodiment.

The manual feed tray 54 is a portion where manual feed paper is placed, and is provided on the right side surface of the image forming apparatus 100.

The paper discharge tray 55 is a portion to which the printed paper is discharged, and is provided on the left side surface of the image forming apparatus 100.

The sheet conveying unit 70 is a portion that conveys a sheet, which is a central portion of the image forming apparatus and is provided between the sheet feed cassette 53 and the image forming unit 80.

The image forming unit 80 is a portion for forming an image (toner image) on a sheet, which is a central portion of the image forming apparatus 100 and is provided between the scanner unit 51 and the sheet conveying unit 70.

The fixing device 90 is a portion that fixes the toner image on the sheet, and is provided on a conveying path TR3 of the sheet conveying unit 70 which will be described later.

The recovery container 20 is a container that stores the waste toner discharged from the image forming unit 80, and is provided in front of the image forming unit 80 and above the sheet conveying unit 70. The recovery container 20 can be attached to and detached from the image forming apparatus main body 100*a*.

The image forming apparatus 100 further includes a door 56 that can be opened and closed on the front surface thereof. When the door 56 is opened, the recovery container 20 and the sheet conveying unit 70 (in particular, the conveying paths TR1, TR2, and TR3 to be described later) are exposed. The user of the image forming apparatus 100 can take out the recovery container 20 from the image forming apparatus main body 100*a* while the door 56 opened. The user of the image forming apparatus 100 can perform jam recovering action, when a jam occurs in the conveying paths TR1, TR2, or TR3.

Figure 2:
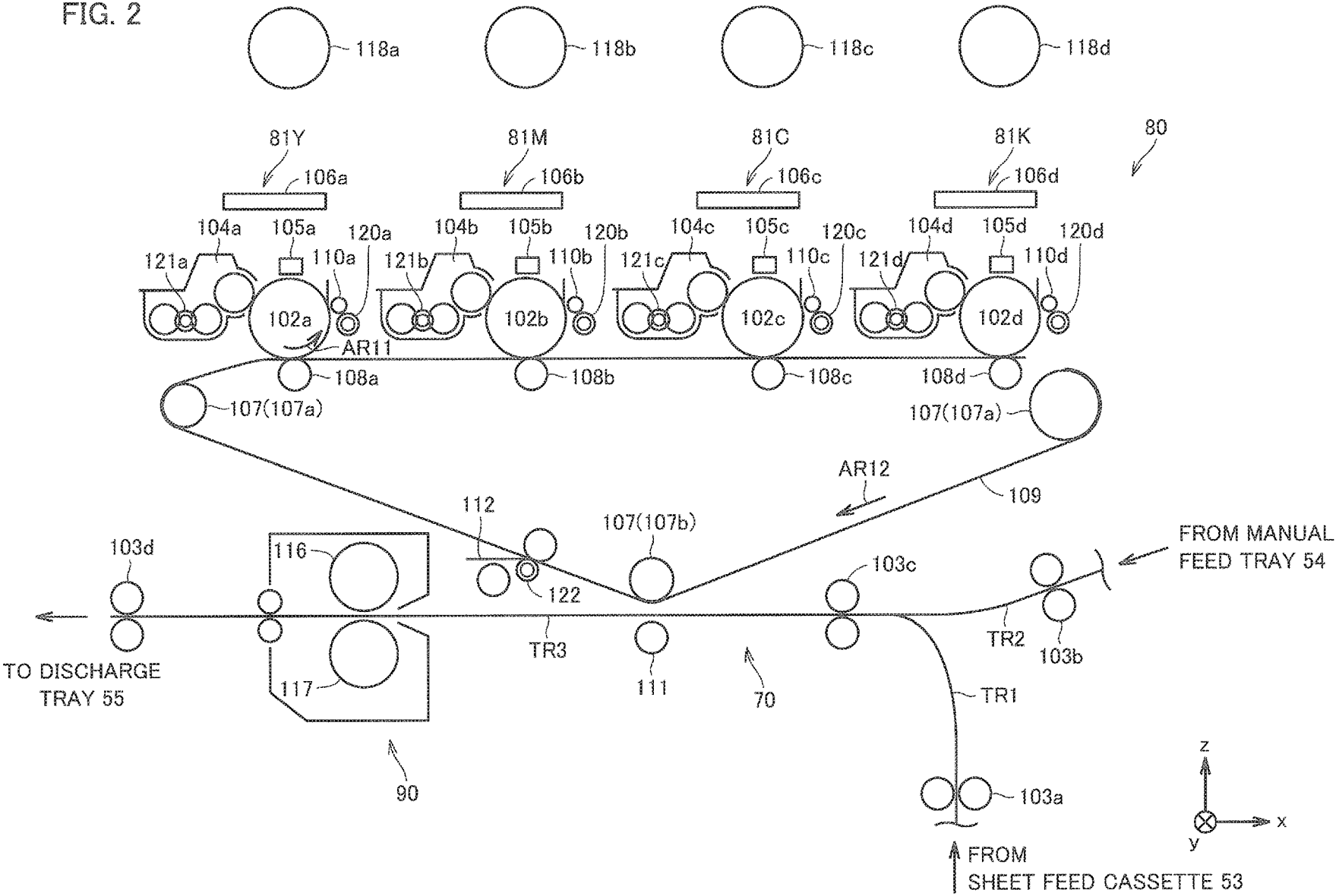
FIG. 2 is a cross-sectional view showing configurations of a sheet conveying unit 70, an image forming unit 80, and a fixing device 90, in the image forming apparatus 100, according to the embodiment of the present invention.

FIG. 2 is a cross-sectional view showing configurations of the sheet conveying unit 70, the image forming unit 80, and the fixing device 90 in the image forming apparatus 100, according to the embodiment of the present invention.

Referring to FIG. 2, sheet conveying unit 70 has conveying paths TR1, TR2, and TR3 for conveying the sheet. The conveying path TR1 extends in a substantially vertical direction from the sheet feed cassette 53 to a joining position with the conveying path TR2. The conveying path TR2 extends substantially in the horizontal direction from the manual feed tray 54 to the joining position with the conveying path TR1. The conveying path TR3 extends substantially in the horizontal direction at the lower portion of the image forming unit 80. The conveying path TR3 extends from the joining position of the conveying path TR1 and the conveying path TR2 to the discharge tray 55.

The sheet conveying unit 70 includes conveying rollers 103*a* and 103*b*, a timing roller 103*c*, and a discharge roller 103*d*. The paper feed tray 11 is provided at a lower portion of the image forming apparatus main body 100*a* and accommodates paper for forming images.

The conveying roller 103*a* is provided on the conveying path TR1 extends from the sheet feed cassette 53. The conveying roller 103*b* is provided on the conveying path TR2 extends from the manual feed tray 54. The timing roller 103*c* is provided on the conveying path TR3 downstream from the joining position of the conveying path TR1 and the conveying path TR2, and is provided on the upstream side of the secondary transfer roller 111. The sheet discharge roller 103*d* is provided in the most downstream portion of the conveying path TR3.

The image forming unit 80 synthesizes images of four colors of Y (yellow), M (magenta), C (cyan), and K (black) in a so-called tandem system, and transfers the toner image to the paper. The image forming unit 80 includes four sets of image forming units 81Y, 81M, 81C, and 81K, and exposure devices 106*a*, 106*b*, 106*c*, and 106*d*. The image forming unit 80 includes rotating rollers 107, an intermediate transfer belt 109, and primary transfer rollers 108*a*, 108*b*, 108*c*, and 108*d*. The image forming unit 80 includes a secondary transfer roller 111, a cleaning device 112, toner bottles 118*a*, 118*b*, 118*c*, and 118*d*, and the like.

Each of the image forming units 81Y, 81M, 81C, and 81K is juxtaposed on the top of the intermediate transfer belt 109. The image forming unit 81Y includes a photosensitive member 102*a*, a charging device 105*a*, a developing device 104*a*, a cleaning device 110*a*, and the like. The photosensitive member 102*a* is rotationally driven in a direction indicated by an arrow AR11 in FIG. 2. A charging device 105*a*, a developing device 104*a*, and a cleaning device 110*a* are arranged around the photosensitive member 102*a*.

The image forming unit 81M includes a photosensitive member 102*b*, a charging device 105*b*, a developing device 104*b*, a cleaning device 110*b*, and the like. The image forming unit 81C includes a photosensitive member 102*c*, a charging device 105*c*, a developing device 104*c*, a cleaning device 110*c*, and the like. The image forming unit 81K includes a photosensitive member 102*d*, a charging device 105*d*, a developing device 104*d*, a cleaning device 110*d*, and the like. Each of the image forming units 81M, 81C, and 81K has the same configuration as that of the image forming unit 81Y.

Each of the exposure devices 106*a*, 106*b*, 106*c*, and 106*d* is provided above each of the image forming units 81Y, 81M, 81C, and 81K. The intermediate transfer belt 109 is provided under the image forming units 81Y, 81M, 81C, and 81K. The intermediate transfer belt 109 is annular, and is laid across rotating rollers 107. The intermediate transfer belt 109 is rotationally driven in a direction indicated by an arrow AR12 in FIG. 2. Each of the primary transfer rollers 108*a*, 108*b*, 108*c*, and 108*d* faces each of the photosensitive members 102*a*, 102*b*, 102*c*, and 102*d* with the intermediate transfer belt 109 interposed therebetween. The secondary transfer roller 111 is in contact with the intermediate transfer belt 109 on the conveying path TR3. The interval between the secondary transfer roller 111 and the intermediate transfer belt 109 can be adjusted by a pressure contacting and separating mechanism (not shown).

The rotating roller 107 includes a plurality of rotating rollers 107*a* and a rotating roller 107*b*. Each of the plurality of rotating rollers 107*a* is disposed in a substantially horizontal direction to each other, and the intermediate transfer belt 109 is stretched. The rotating roller 107*b* is disposed below the plurality of rotating rollers 107*a*, and the intermediate transfer belt 109 is stretched.

The cleaning device 112 is in contact with the intermediate transfer belt 109, in the vicinity of the rotating roller 107*b* at the lowermost part, and between the rotating roller 107*a* and the rotating roller 107*b*. The cleaning device 112 removes the waste toner on the intermediate transfer belt 109 at this position.

Toner bottles 118*a*, 118*b*, 118*c*, and 118*d* are located above exposure devices 106*a*, 106*b*, 106*c*, and 106*d*.

The fixing device 90 is provided on the conveying path TR3 between the secondary transfer roller 111 and the discharge roller 103*d*. The fixing device 90 includes a heating roller 116 and a pressure roller 117. The fixing device 90 fixes the toner image on the sheet by conveying it along the conveying path TR3 while gripping the sheet bearing the toner image by the nip portion between the heating roller 116 and the pressure roller 117.

The image forming apparatus 100 rotates the photosensitive member 102*a* to charge the surface of the photosensitive member 102*a* to a desired potential, by the charging device 105*a*. In the image forming apparatus 100, the surface of the charged photosensitive member 102*a* is exposed by the exposure device 106*a* according to the image formation information, and an electrostatic latent image according to the image formation information is written on the surface of the photosensitive member 102*a*. The electrostatic latent image is held by the photosensitive member 102*a*.

Next, the image forming apparatus 100 supplies toner from the developing device 104*a* to the photosensitive member 102*a* on which the electrostatic latent image has been formed (development with toner). As a result, the image forming apparatus 100 forms a toner image of Y color on the surface of the photosensitive member 102*a*.

The image forming apparatus 100 forms toner images of MCK colors on the surfaces of the photosensitive members 102*b*, 102*c*, and 102*d* in the same manner.

Next, the image forming apparatus 100 sequentially transfers the toner images of the respective colors formed on the photosensitive members 102*a*, 102*b*, 102*c*, and 102*d* onto the surface of the intermediate transfer belt 109 (primary transfer), by using each of the primary transfer rollers 108*a*, 108*b*, 108*c*, and 108*d*. On the surface of the intermediate transfer belt 109, a toner image in which toner images of respective colors are synthesized is formed.

Subsequently, the image forming apparatus 100 conveys the toner image formed on the surface of the intermediate transfer belt 109 to a position facing the secondary transfer roller 111, by the rotating roller 107.

Meanwhile, the image forming apparatus 100 feeds the paper placed in the sheet feed cassette 53 by a paper feed roller (not shown), conveys the paper along the conveying path TR1 to the joining position with the conveying path TR2 using the conveying roller 103*a*. Or, the image forming apparatus 100 feeds the paper placed on the manual feed tray 54 by a paper feed roller (not shown), and conveys the paper along the conveying path TR2 to the joining position with the conveying path TR1 by using the conveying roller 103*b*. Then, the image forming apparatus 100 guides the sheet conveyed to the joining position of the conveying path TR1 and the conveying path TR2 along the conveying path TR3 between the intermediate transfer belt 109 and the secondary transfer roller 111 at a predetermined timing, using the timing roller 103*c*. Then, the image forming apparatus 100 transfers the toner image formed on the surface of the intermediate transfer belt 109 to the sheet by the secondary transfer roller 111.

The image forming apparatus 100 guides the sheet to which the toner image has been transferred to the fixing device 90, and fixes the toner image on the sheet by the fixing device 90. Thereafter, the image forming apparatus 100 discharges the sheet on which the toner image has been fixed onto the paper discharge tray 55, by the paper discharge roller 103*d*.

The image forming apparatus 100 supplies the toner stored in the appropriate color bottle among the YMCK toner bottles 118*a*, 118*b*, 118*c*, and 118*d* to the developing devices 104*a*, 104*b*, 104*c*, or 104*d* by image formation, when the amount of toner in the developing units 104*a*, 104*b*, 104*c*, or 104*d* decreases due to image formation.

The image forming apparatus 100 further includes waste toner conveying pipes 120*a*, 120*b*, 120*c*, and 120*d* (an example of a first waste toner conveying pipe). The image forming apparatus 100 further includes waste toner conveying pipes 121*a*, 121*b*, 121*c*, and 121*d* (an example of a first waste toner conveying pipe) and a waste toner conveying pipe 122 (an example of a second waste toner conveying pipe). The waste toner conveying pipes 120*a*, 120*b*, 120*c*, and 120*d*, the waste toner conveying pipes 121*a*, 121*b*, 121*c*, and 121*d* and the waste toner conveying pipe 122 convey the waste toner. The waste toner is discharged from members having different functions constituting the image forming unit 80.

The image forming apparatus 100 removes residual waste toner (waste toner discharged from each of the photosensitive members 102*a*, 102*b*, 102*c*, and 102*d*) on each of the photosensitive members 102*a*, 102*b*, 102*c*, and 102*d* without being transferred to the intermediate transfer belt 109, by using each of the cleaning devices 110*a*, 110*b*, 110*c*, and 110*d*. The image forming apparatus 100 conveys the waste toner to the recovery container 20 using each of the waste toner conveying pipes 120*a*, 120*b*, 120*c*, and 120*d*.

Each of the waste toner conveying pipes 120*a*, 120*b*, 120*c*, and 120*d* projects toward the front of the image forming apparatus 100, from each of the cleaning devices 110*a*, 110*b*, 110*c*, and 110*d*, and is connected to the recovery container 20. Therefore, the image forming apparatus 100 conveys the waste toner discharged from each of the photosensitive members 102*a*, 102*b*, 102*c*, and 102*d* to the front recovery container 20, without passing through the rear portion and the side portion of the image forming unit 80.

The image forming apparatus 100 conveys the waste toner discharged from each of the developing devices 104*a*, 104*b*, 104*c*, and 104*d* to the recovery container 20, by using each of the waste toner conveying pipes 121*a*, 121*b*, 121*c*, and 121*d*.

Each of the waste toner conveying pipes 121*a*, 121*b*, 121*c*, and 121*d* projects toward the front of the image forming apparatus 100, from each of the developing devices 104*a*, 104*b*, 104*c*, and 104*d*, and is connected to the recovery container 20. Therefore, the image forming apparatus 100 conveys the waste toner discharged from each of the developing devices 104*a*, 104*b*, 104*c*, and 104*d* to the front recovery container 20, without passing through the rear portion and the side portion of the image forming unit 80.

The image forming apparatus 100 removes the waste toner remaining on the intermediate transfer belt 109 (waste toner discharged from the intermediate transfer belt 109) without being transferred onto the sheet by using the cleaning device 112. The image forming apparatus 100 transports the waste toner to the recovery container 20 using the waste toner conveying pipe 122.

The waste toner conveying pipe 122 protrudes from the cleaning device 112 toward the front of the image forming apparatus 100 and is connected to the recovery container 20. Therefore, the image forming apparatus 100 conveys the waste toner discharged from the intermediate transfer belt 109 to the front recovery container 20, without passing through the rear portion and the side portion of the image forming unit 80.

Next, the configuration of the recovery container in this embodiment will be described.

Figure 3:
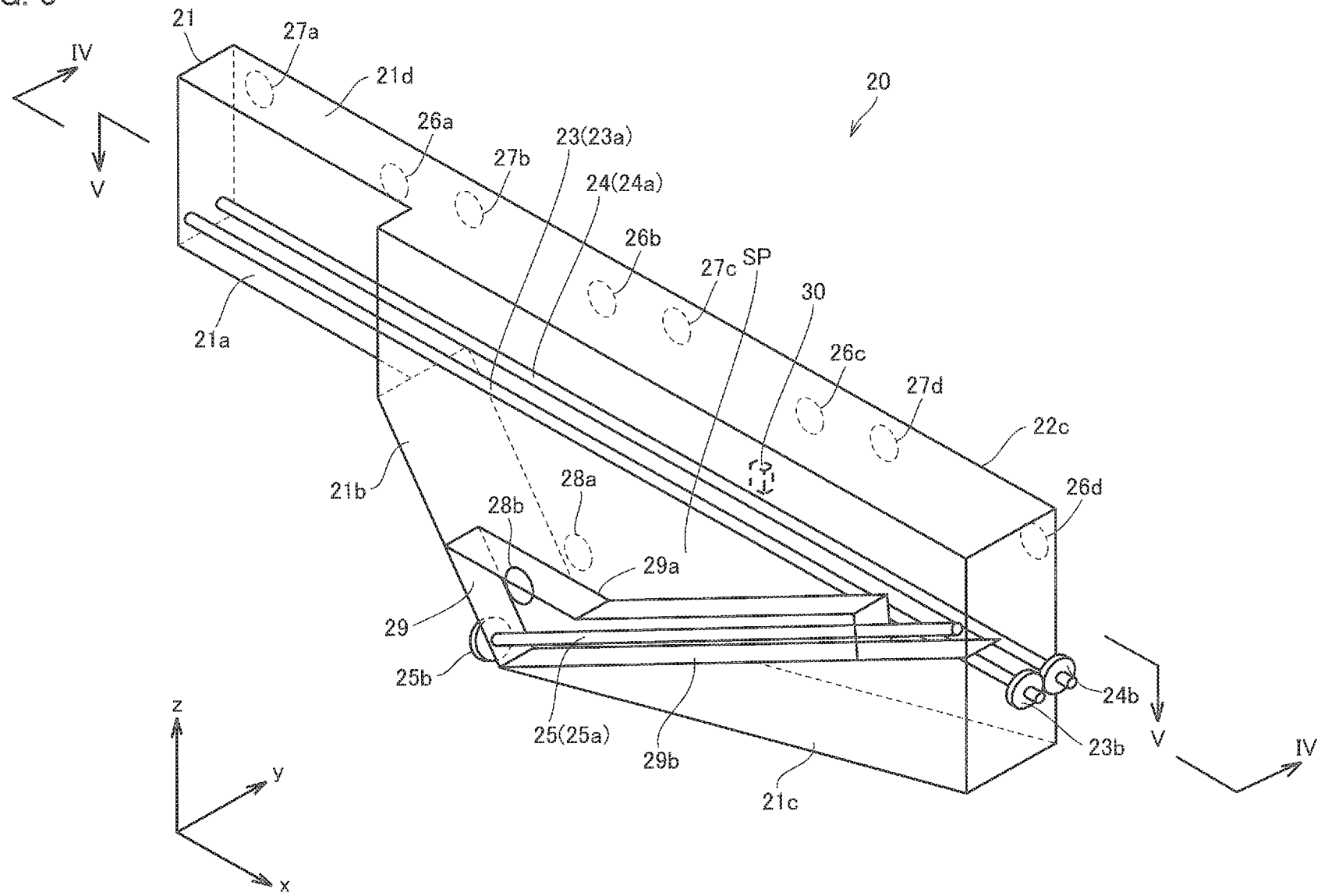
FIG. 3 is a perspective view showing a configuration of a recovery container 20, according to the embodiment of the present invention.
Figure 4:
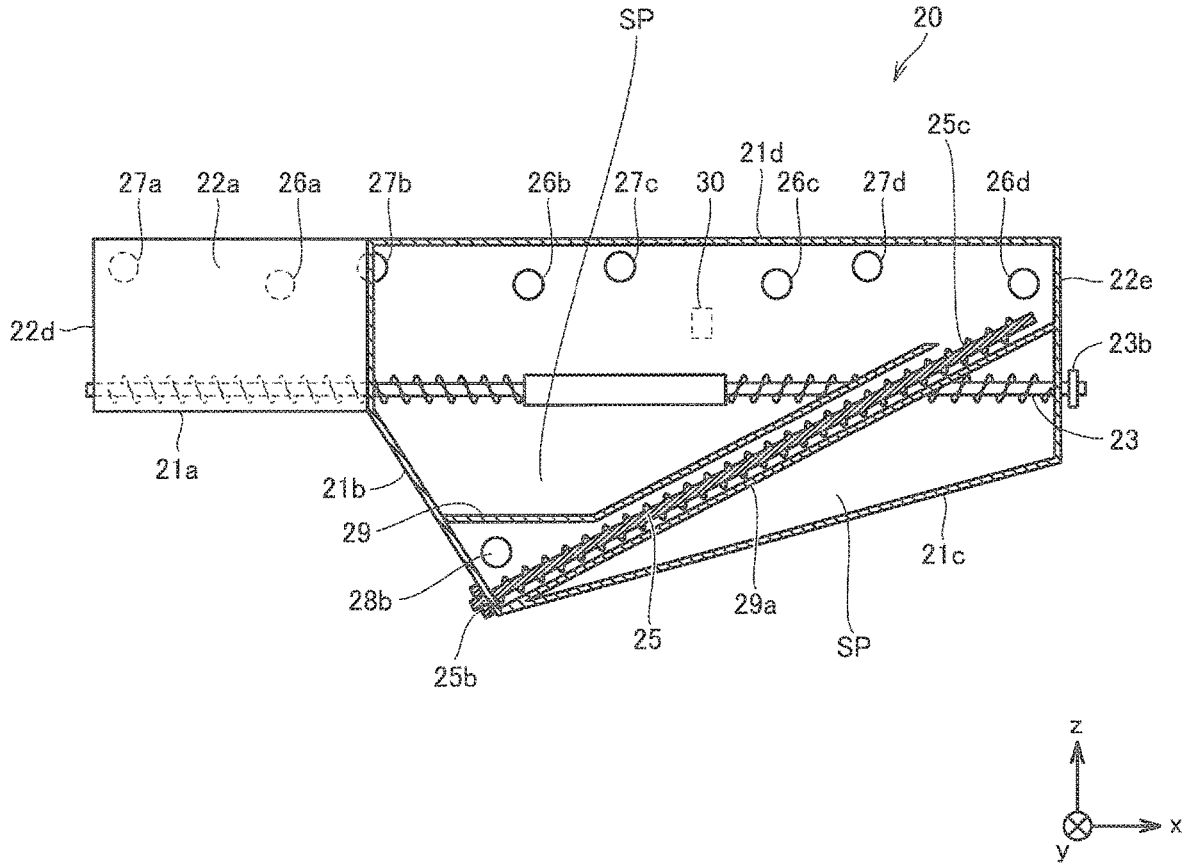
FIG. 4 is a cross-sectional view taken along the line IV-IV (a plane including a rotation axis 25*a*) in FIG. 3.
Figure 5:
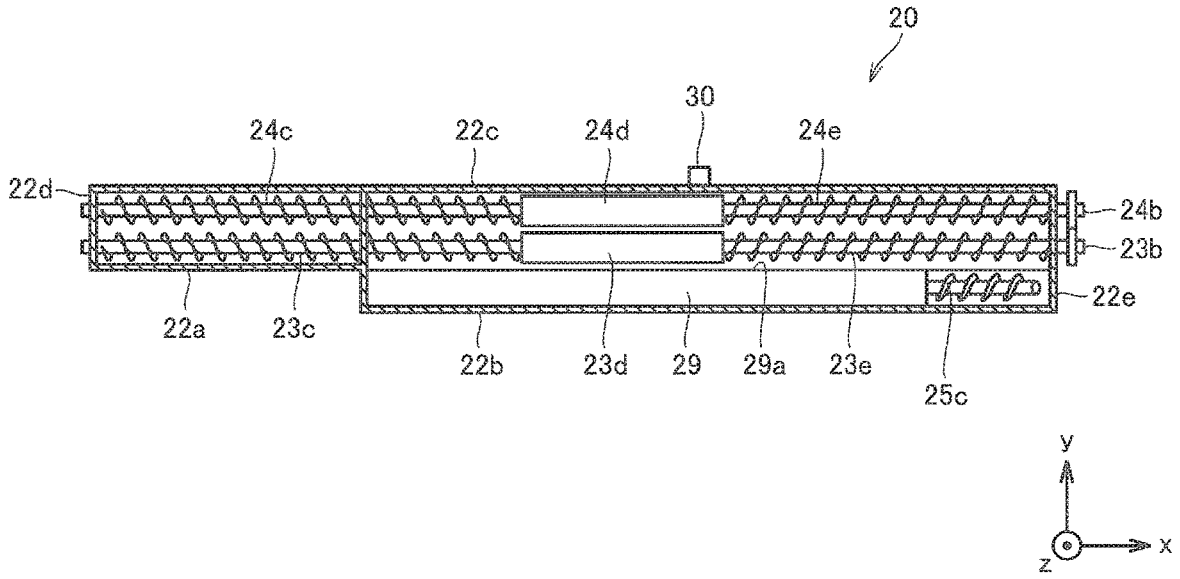
FIG. 5 is a cross-sectional view taken along the line V-V of FIG. 3.

FIG. 3 to FIG. 5 are diagrams showing a configuration of a recovery container 20 according to an embodiment of the present invention. FIG. 3 is a perspective view. FIG. 4 is a cross-sectional view taken along the line IV-IV (the plane including the rotation axis 25*a*) in FIG. 3. FIG. 5 is a cross-sectional view taken along line V-V in FIG. 3. In FIG. 3, for convenience of explanation, illustration of the spiral blade portions in each of the first conveying units 23 and 24 and the second conveying unit 25 is omitted.

With reference to FIG. 3 to FIG. 5, the recovery container 20 includes a casing 21, first conveying units 23 and 24 (an example of a first conveying unit), a second conveying unit 25 (an example of a second conveying unit), and a detection window 30. In the casing 21, first conveying units 23 and 24 and a second conveying unit 25 are provided.

The casing 21 includes a left bottom portion 21*a*, a center bottom portion 21*b*, a right bottom portion 21*c*, a ceiling portion 21*d*, and front side walls 22*a* and 22*b*. The casing 21 includes a rear side wall 22*c*, a left side wall 22*d*, and a right side wall 22*e*. The casing 21 includes receiving ports 26*a*, 26*b*, 26*c*, and 26*d* (an example of a first receiving port). The casing 21 includes receiving ports 27*a*, 27*b*, 27*c*, and 27*d* (an example of a first receiving port). The casing 21 includes a receiving port 28*a* (an example of a second receiving port), a conveying pipe 29 (an example of a separating unit), and the like.

The left bottom portion 21*a* is a bottom portion of the left end portion of the recovery container 20 and extends in a substantially horizontal direction. The right bottom portion 21*c* is the bottom portion of the right end portion of the recovery container 20 and extends obliquely downward to the left toward the boundary with the center bottom portion 21*b*. The center bottom portion 21*b* is a bottom portion between the left bottom portion 21*a* and the right bottom portion 21*c*, and extends diagonally downward to the right from the boundary with the left bottom portion 21*a* toward the boundary with the right bottom portion 21*c*.

The front side wall 22*a* is continuous with the left bottom portion 21*a* on the front left side of the recovery container 20, and is an upright side wall. The front side wall 22*b* is continuous with the center bottom 21*b* and the right bottom 21*c* on the front right side of the recovery container 20, and is an upright side wall. The front side wall 22*b* protrudes forward from the front side wall 22*a*. The rear side wall 22*c* is continuous with the left bottom portion 21*a*, the center bottom portion 21*b*, and the right bottom portion 21*c* on the rear side of the recovery container 20, and is an upright side wall.

The ceiling portion 21*d* is continuous with the front side walls 22*a* and 22*b*, the rear side wall 22*c*, the left side wall 22*d*, and the right side wall 22*e*, and extends in a substantially horizontal direction.

The portion having the center bottom portion 21*b* and the right bottom portion 21*c* of the recovery container 20 as the bottom surface is deeper than the portion having the left bottom portion 21*a* as the bottom surface. The space defined by the center bottom portion 21*b*, the right bottom portion 21*c*, the front side wall 22*b*, the rear side wall 22*c*, and the right side wall 22*e*, which is the space outside the conveying pipe 29 constitutes the accommodating unit SP for accommodating the waste toner.

The conveying pipe 29 is provided adjacent to the center bottom portion 21*b* and the front side wall 22*b*. The conveying pipe 29 accommodates a part of the second conveying unit 25. The conveying pipe 29 separates a portion (left side portion) on the upstream side in the conveying direction of the second conveying unit 25 in the second conveying unit 25, from the accommodating unit SP. The conveying pipe 29 exposes a portion (right side portion) of the second conveying unit 25 on the downstream side in the conveying direction of the second conveying unit 25, to the accommodating unit SP. The conveying pipe 29 extends diagonally upward to the right from the boundary between the center bottom portion 21*b* and the right bottom portion 21*c* (the lowermost end portion of the casing 21).

The cross-sectional shape of the conveying pipe 29 is arbitrary. In addition to the rectangular shape as in this embodiment, the cross-sectional shape of the conveying pipe 29 may be a circular shape or another shape, and is preferably determined from the viewpoint of space saving.

Receiving ports 26*a*, 26*b*, 26*c*, and 26*d*, receiving ports 27*a*, 27*b*, 27*c*, and 27*d* and a receiving port 28*a* are formed in the rear side wall 22*c*. A receiving port 28*b* (an example of a second receiving port) is formed in the rear side wall 29*a* of the conveying pipe 29.

Each of the receiving ports 26*a*, 26*b*, 26*c*, and 26*d* (an example of the photosensitive member waste toner receiving port) is an opening for receiving waste toner (waste toner discharged from the photosensitive members 102*a*, 102*b*, 102*c*, and 102*d*). The waste toner is conveyed by the waste toner conveying pipes 120*a*, 120*b*, 120*c*, and 120*d*. The receiving ports 26*a*, 26*b*, 26*c*, and 26*d* are arranged in a substantially horizontal direction.

Each of the receiving ports 27*a*, 27*b*, 27*c*, and 27*d* (an example of the developing device waste toner receiving port) is an opening for receiving waste toner (waste toner discharged from the developing devices 104*a*, 104*b*, 104*c*, and 104*d*). The waste toner is conveyed by the waste toner conveying pipes 121*a*, 121*b*, 121*c*, and 121*d*. The receiving ports 27*a*, 27*b*, 27*c*, and 27*d* are arranged in a substantially horizontal direction.

The receiving ports 28*a* and 28*b* are openings for receiving waste toner conveyed by the waste toner conveying pipe 122 (waste toner discharged from the intermediate transfer belt 109 and waste toner removed by the cleaning device 112). The receiving ports 28*a* and 28*b* are provided below the receiving ports 26*a*, 26*b*, 26*c*, and 26*d* and the receiving ports 27*a*, 27*b*, 27*c*, and 27*d*.

The detection window 30 is provided at a position above the first conveying units 23 and 24, in the rear side wall 22*c*. The detection window 30 protrudes rearward from the rear side wall 22*c*. The detection window 30 is a detection position of the waste toner contained in the casing 21, for the control unit 50 to detect the waste toner using the sensor 126 (FIG. 10) described later.

The first conveying units 23 and 24 convey the waste toner in the casing 21. The first conveying units 23 and 24 convey the waste toner in a substantially horizontal direction and equalize the upper surface of the waste toner accommodated in the accommodating unit SP.

The first conveying unit 23 is provided above the left bottom portion 21*a* and includes a rotary shaft 23*a*, a drive transmission portion 23*b*, a blade portion 23*c*, a rod portion 23*d*, and a blade portion 23*e*.

The rotary shaft 23*a* is rotatably supported with respect to each of the left side wall 22*d* and the right side wall 22*e*, and extends in a substantially horizontal direction.

The drive transmission portion 23*b* is provided at the right end portion of the rotary shaft 23*a* protruding to the outside of the casing 21. The drive transmission portion 23*b* transmits a driving force for rotationally driving the rotary shaft 23*a*, the blade portion 23*c*, the rod portion 23*d*, and the blade portion 23*e*.

The blade portion 23*c* is attached to the left side position of the rotary shaft 23*a*. The blade portion 23*c* is rotatable around the rotary shaft 23*a* and has the shape of a spiral blade. The blade portion 23*c* transports the waste toner in the direction of the rod portion 23*d* (to the right).

The blade portion 23*e* is attached to the right side position of the rotary shaft 23*a*. The blade portion 23*e* is rotatable around the rotary shaft 23*a* and has the shape of a spiral blade. The blade portion 23*e* transports the waste toner in the direction of the rod portion 23*d* (left direction).

The rod portion 23*d* is provided between the blade portion 23*c* and the blade portion 23*e*, and does not have blades.

The first conveying unit 24 is provided between the first conveying unit 23 and the rear side wall 22*c*, and has substantially the same configuration as the first conveying unit 23. The first conveying unit 24 includes a rotary shaft 24*a* corresponding to the rotary shaft 23*a* and a drive transmission unit 24*b* corresponding to the drive transmission unit 23*b*. The first conveying unit 24 includes a blade portion 24*c* corresponding to the blade portion 23*c*, a rod portion 24*d* corresponding to the rod portion 23*d*, and a blade portion 24*e* corresponding to the blade portion 23*e*.

It is to be noted that the casing 21 may further include a wall that partitions the first conveying units 23 and 24.

The second conveying unit 25 transports the waste toner in the casing 21. The second conveying unit 25 conveys the waste toner received from the second receiving port 28*b* obliquely upward and rightward (in a direction forming an angle with respect to each of the horizontal direction and the vertical direction) from the lowermost end portion of the casing 21. The second conveying unit 25 transports the waste toner to a position higher than the detection window 30 and the first conveying units 23 and 24. The second conveying unit 25 includes a rotary shaft 25*a*, a drive transmission portion 25*b*, and a blade portion 25*c*.

The left end portion of the rotary shaft 25*a* (the upstream end portion in the conveying direction of the second conveying unit 25) is rotatably supported with respect to the central bottom portion 21*b*. The right end portion of the rotary shaft 25*a* (the downstream end portion in the conveying direction of the second conveying unit 25) is released. The right end portion of the rotary shaft 25*a* is located above the detection window 30 and the first conveying units 23 and 24. Further, the rotary shaft 25*a* is offset toward the lower surface 29*b* side of the conveying pipe 29 in the conveying pipe 29.

The drive transmission portion 25*b* is provided at the left end portion of the rotary shaft 25*a* protruding to the outside of the casing 21. The drive transmission portion 25*b* transmits a driving force for rotationally driving the rotary shaft 25*a* and the blade portion 25*c*.

The blade portion 25*c* is rotatable around the rotary shaft 25*a* and has the shape of a spiral blade. The blade portion 25*c* is attached over the entire rotary shaft 25*a*. The blade portion 25*c* conveys the waste toner along the rotary shaft 25*a* in the upper right direction, during rotation.

The direction in which the waste toner is conveyed by the first conveying units 23 and 24 is arbitrary. The conveying direction is preferably parallel to at least one of the arrangement direction of the receiving ports 26*a*, 26*b*, 26*c*, and 26*d* and the arrangement direction of the receiving ports 27*a*, 27*b*, 27*c*, and 27*d*. The recovery container 20 may include only one first conveying unit.

Next, the operation of the waste toner conveying pipe 130 when the recovery container 20 is mounted on the image forming apparatus main body 100*a*, will be described.

Figure 6:
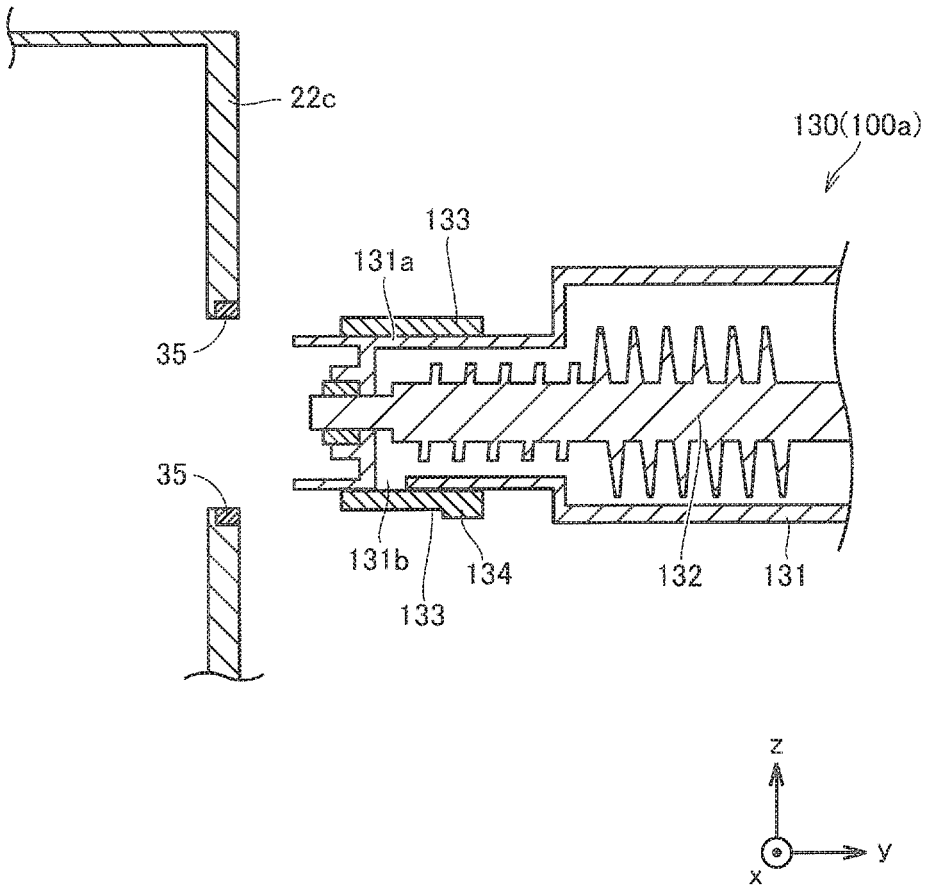
FIG. 6 is a cross-sectional view showing a configuration of a waste toner conveying pipe 130, before the recovery container 20 is mounted on the image forming apparatus main body 100*a*, in the embodiment of the present invention.
Figure 7:
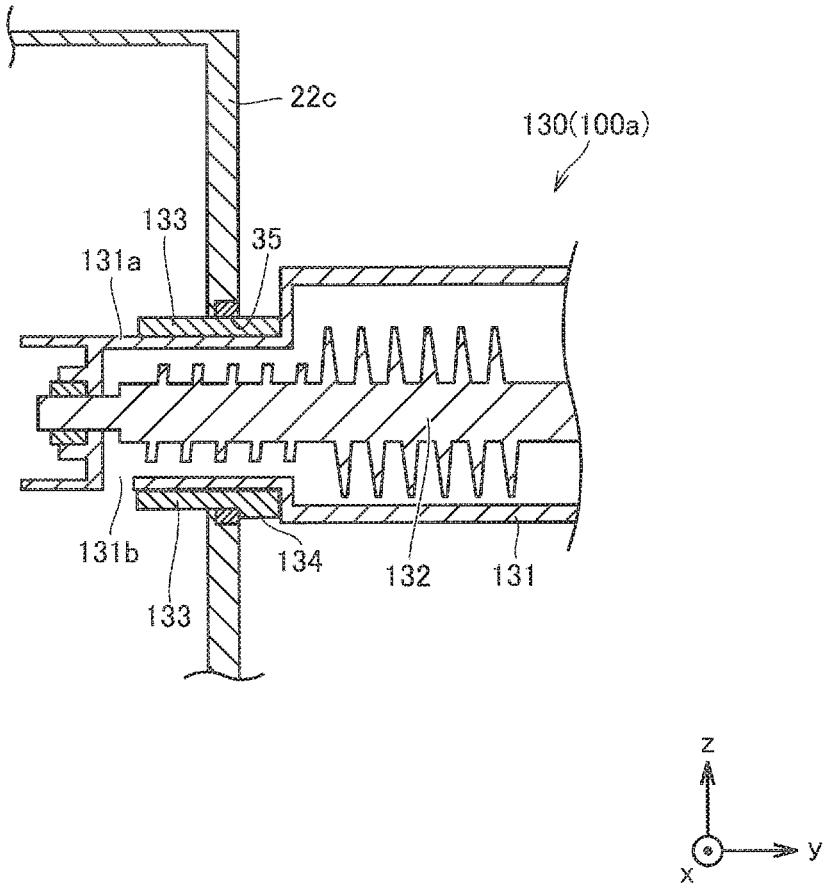
FIG. 7 is a cross-sectional view showing a configuration of a waste toner conveying pipe 130, after the recovery container 20 is mounted on the image forming apparatus main body 100*a*, in the embodiment of the present invention.

FIG. 6 is a cross-sectional view showing a configuration of the waste toner conveying pipe 130 before the recovery container 20 is mounted on the image forming apparatus main body 100*a*, in the embodiment of the present invention. FIG. 7 is a cross-sectional view showing a configuration of the waste toner conveying pipe 130 after the recovery container 20 according to the embodiment of the present invention is mounted on the image forming apparatus main body 100*a*. In FIG. 6 and FIG. 7, the waste toner conveying pipe 130 corresponds to each of the waste toner conveying pipes 120*a*, 120*b*, 120*c*, 120*d*, 121*a*, 121*b*, 121*c*, 121*d*, and 122. In addition, what corresponds to each of the receiving ports 26*a*, 26*b*, 26*c*, 26*d*, 27*a*, 27*b*, 27*c*, 27*d*, and 28 a is shown as the receiving port 35.

Referring to FIG. 6, waste toner conveying pipe 130 is a member on the image forming apparatus main body 100*a* side, and includes a pipe main body 131, a conveying screw 132, a shutter 133, a projecting portion 134, and the like. The pipe main body 131 has a hollow cylindrical shape and projects linearly toward the front of the image forming apparatus 100 (left direction in FIG. 6) from a member serving as a source of waste toner. The pipe main body 131 has a distal end portion 131*a* provided at the distal end portion thereof and a discharge port 131*b* opened at the lower portion of the distal end portion 131*a*. The distal end portion 131*a* has a smaller diameter than other portions of the pipe main body 131. The discharge port 131*b* is an opening for discharging the waste toner carried by the waste toner conveying pipe 130.

The conveying screw 132 is provided inside the pipe main body 131. The conveying screw 132 is driven to rotate under the control of the control unit 50 and conveys the waste toner along the pipe main body 131. The conveying screw 132 is rotatably supported by a supporting portion provided on the distal end side of the distal end portion 131*a*.

The shutter 133 has a cylindrical shape and is attached to the outer periphery of the distal end portion 131*a*. The shutter 133 has an outer shape that is substantially the same as the inner diameter of the receiving port 35. The shutter 133 is slidable along the outer periphery of the distal end portion 131*a*. The shutter 133 is urged forward (toward the left in FIG. 6) of the waste toner conveying pipe 130 by an urging member (not shown). When the recovery container 20 is not attached to the image forming apparatus main body 100*a*, the shutter 133 covers the discharge port 131*b*, and the discharge port 131*b* is in a closed state.

The projecting portion 134 is provided at the lower portion of the shutter 133 on the outer periphery of the shutter 133. The projecting portion 134 protrudes to the outer diameter side from the outer periphery of the shutter 133.

With reference to FIG. 7, the recovery container 20 is attached to the image forming apparatus main body 100*a*. Then, the projecting portion 134 is pushed to rearward (rightward in FIG. 6) of the image forming apparatus 100, by the rear side wall 22*c* of the lower portion of the receiving port 35. As a result, the shutter 133 slides to the rear of the image forming apparatus 100, and the discharge port 131*b* is opened. The waste toner conveyed by the conveying screw 132 is discharged into the casing 21 through the discharge port 131*b*.

It is to be noted that the distal end portion 131*a* of the waste toner conveying pipe 122 extends further forward beyond the distal end portion 131*a* of the other waste toner conveying pipes. When the recovery container 20 is attached to the image forming apparatus main body 100*a*, the distal end portion 131*a* of the waste toner conveying pipe 122 passes through both of the receiving ports 28*a* and 28*b*, and the discharge port 131*b* reaches the inside of the conveying pipe 29.

Next, the operation of the image forming apparatus 100 according to the present embodiment will be described.

Figure 8:
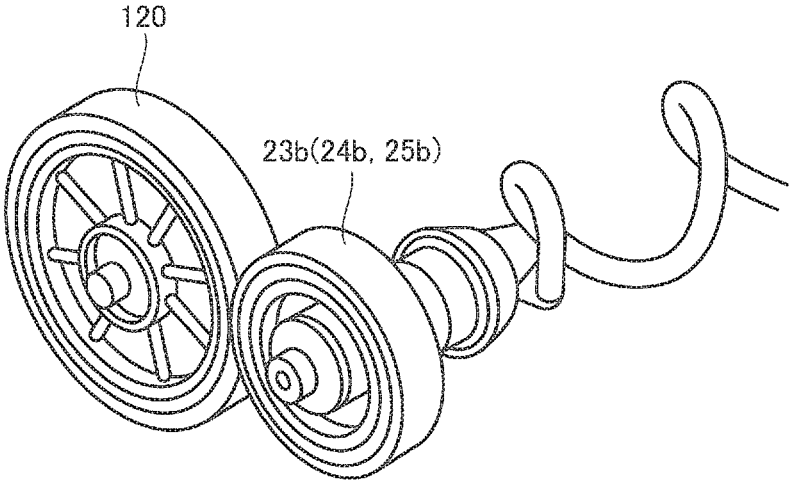
FIG. 8 is a perspective view showing a method of transmitting a driving force between a driving unit 120 and a drive transmission unit 23*b*, according to an embodiment of the present invention.

FIG. 8 is a perspective view showing a method of transmitting the driving force between the driving unit 120 and the drive transmission unit 23*b*, according to the embodiment of the present invention.

Referring to FIG. 8, image forming apparatus 100 further includes a driving unit 120. The driving unit 120 is, for example, a drive shaft of the motor, and is supplied with electric power under the control of the control unit 50 and rotates. Each of the driving unit 120 and the drive transmission unit 23*b* is in a disk shape, and a belt is provided on the outer periphery thereof. The belt of the driving unit 120 and the belt of the drive transmission unit 23*b* are in contact with each other, and the driving force is transmitted from the driving unit 120 to the drive transmission unit 23*b* by the frictional force therebetween, so that the first conveying unit 23 rotates.

The driving unit 120 and the drive transmission unit 23*b* may transmit the driving force from the driving unit 120 to the drive transmission unit 23*b*, by meshing engagement of the rotating gears.

The method of transmitting the driving force between the driving unit 120 and the drive transmission unit 24*b* is also the same as the method of transmitting the driving force between the driving unit 120 and the drive transmission unit 23*b*. The method of transmitting the driving force between the driving part 120 and the drive transmitting part 25*b* is also the same as the method of transmitting the driving force between the driving part 120 and the drive transmitting part 23*b*. The explanation will not be repeated.

Figure 9:
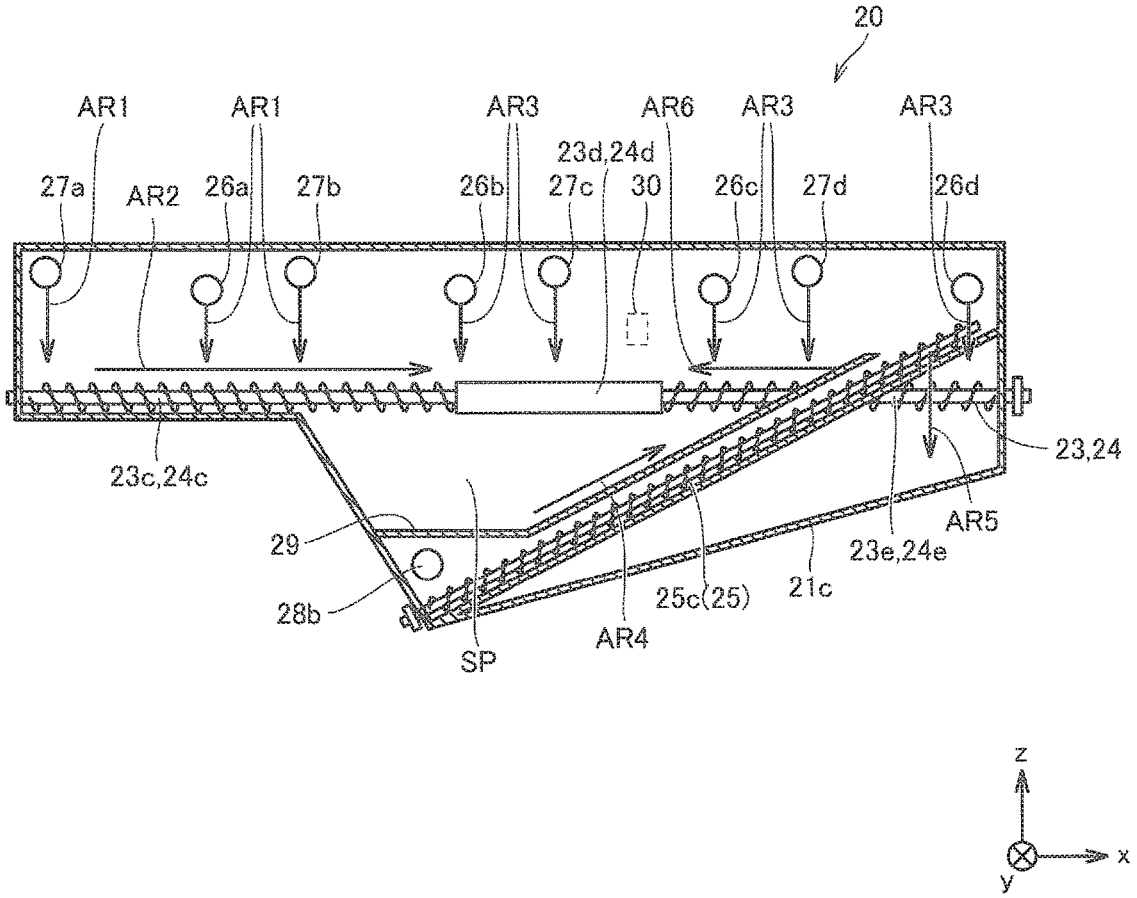
FIG. 9 is a diagram schematically showing the movement of waste toner in a recovery container 20, according to an embodiment of the present invention.

FIG. 9 is a diagram schematically showing the movement of the waste toner in the recovery container 20, according to the embodiment of the present invention.

With reference to FIG. 2 and FIG. 9, the waste toner is conveyed by each of the waste toner conveying pipes 121*a*, 120*a*, and 121*b* existing on the left side of the image forming unit 80. The carried waste toner is discharged into the recovery container 20 through the receiving ports 27*a*, 26*a*, and 27*b*, respectively. The waste toner falls due to its own weight as indicated by an arrow AR1 and then is conveyed as indicated by an arrow AR2 by the blade portions 23*c* and 24*c*, and is housed in the accommodating unit SP.

The waste toner conveying pipes 120*b*, 121*c*, 120*c*, 121*d*, and 120*d* exist in the central portion and the right side of the image forming unit 80. The carried waste toner is discharged into the recovery container 20 through the respective receiving ports 26*b*, 27*c*, 26*c*, 27*d*, and 26*d*, falls due to its own weight as indicated by an arrow AR3, and is housed in the accommodating unit SP.

The waste toner conveyed by the waste toner conveying pipe 122 at the bottom of the image forming unit is discharged into the conveying pipe 29 through the receiving ports 28*a* and 28*b*. The waste toner is conveyed to the downstream end portion (right end portion) of the second conveying unit 25 by the blade portion 25*c* as indicated by an arrow AR4. The waste toner conveyed by the second conveying unit 25 falls from the downstream end portion of the second conveying unit 25 due to its own weight, as indicated by an arrow AR5 and is accommodated in the accommodating unit SP.

When the amount of waste toner in the recovery container 20 increases, the position of the upper surface of the waste toner accommodated in the accommodating unit SP rises and reaches the first conveying unit 23 or 24. The blade portion 23*c* of the first transport portion 23 and the blade portion 24*c* of the first transport portion 24 transport the waste toner which reached the first conveying unit 23 or 24 to the positions of the rod portions 23*d* and 24*d* as indicated by the arrow AR2 on the left side in the accommodating unit SP. The blade portion 23*e* of the first transport portion 23 and the blade portion 24*e* of the first transport portion 24 transport the waste toner which reached the first conveying unit 23 or 24 to the positions of the rod portions 23*d* and 24*d* as indicated by the arrow AR6 on the right side in the accommodating unit SP. As a result, the height of the upper surface of the waste toner accommodated in the accommodating unit SP is equalized (leveled).

When the amount of waste toner in the recovery container 20 further increases, the position of the upper surface of the waste toner stored in the accommodating unit SP exceeds the first conveying units 23 and 24 and reaches the detection window 30. The control unit 50 detects the waste toner having reached the detection window 30 by the following method.

Figure 10:
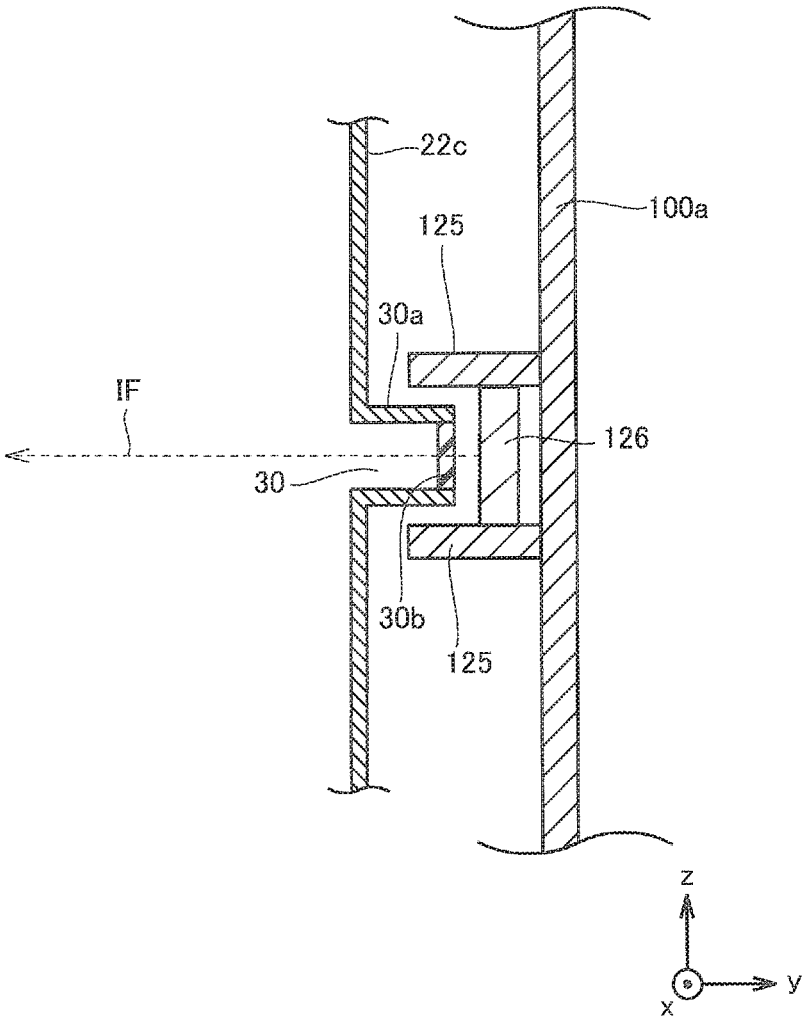
FIG. 10 is a cross-sectional view schematically showing a configuration in the vicinity of a sensor 126, in an embodiment of the present invention.

FIG. 10 is a cross-sectional view schematically showing a configuration in the vicinity of the sensor 126 in the embodiment of the present invention.

Referring to FIG. 10, the detection window 30 has a rectangular shape when viewed from the rear side of the recovery container 20. The detection window 30 includes a projecting portion 30*a* protruding rearward from the rear side wall 22*c* and a transmission window 30*b* surrounded by the projecting portion 30*a*.

The sensor 126 (an example of a detection unit) detects the waste toner stored in the casing 21 at the detection window 30. The sensor 126 is attached to the image forming apparatus main body 100*a*. The sensor 126 irradiates light such as infrared rays forward as indicated by an arrow IF, receives the reflected light, and outputs information indicative of the received light amount to the control unit 50.

A positioning portion 125 protruding forward (in the direction of the recovery container 20) is provided at the upper and lower portions of the sensor 126. When the recovery container 20 is attached to the correct position of the image forming apparatus main body 100*a*, the positioning unit 125 sandwiches the detection window 30 by the upper side and the lower side. As a result, the positioning portion 125 guides the recovery container 20 so as to be mounted at the correct position.

Each of the image forming apparatus main body 100*a* and the recovery container 20 may include an engaging portion that engages with each other when the recovery container 20 is attached to the image forming apparatus main body 100*a*.

In a state in which the recovery container 20 is attached to the image forming apparatus main body 100*a*, the light from the sensor 126 passes through the transmission window 30*b* and is irradiated inside the recovery container 20. When the waste toner contained in the recovery container 20 reaches the detection window 30, the amount of light received by the sensor 126 increases and exceeds a predetermined threshold.

When the amount of light received by the sensor 126 exceeds a predetermined threshold value, the control unit 50 determines that the recovery container 20 is full of waste toner. At this time, the control unit 50 displays (notifies) the operation panel 52 to request discarding of the waste toner in the recovery container 20. The user who saw this display, opens the door 56, takes out the recovery container 20 from the image forming apparatus main body 100*a*, discards the waste toner in the recovery container 20, and reattaches the recovery container 20 to the image forming apparatus main body 100*a*.

[Effect of Embodiment]

According to the present embodiment, the recovery container is provided in front of the image forming unit, and the waste toner discharged from the image forming unit is conveyed to the recovery container, without passing through the rear portion and the side portion of the image forming unit. Therefore, the conveying path of the waste toner can be simplified. As a result, it is possible to reduce the size of the image forming apparatus, and it is possible to reduce the manufacturing cost of the image forming apparatus. In addition, the recovery container is provided above the conveying path for conveying the sheet. Therefore, when the user accesses the conveying path from the front of the image forming apparatus, the recovery container becomes unlikely to be an obstacle, and the operability in performing the jam recovering can be ensured.

Further, the waste toner from the intermediate transfer belt discharged into the recovery container is conveyed upward by the second conveying unit. The upper surface of the waste toner accommodated in the accommodating unit of the recovery container is leveled by the first conveying unit. When the upper surface of the waste toner reaches the upper part than the first conveying part, the full of the waste toner is detected. Thereby, it is possible to avoid a situation in which the full of the recovery container is detected in a state where there is an extra space in the recovery container, and the capacity of the recovery container can be effectively utilized.

According to the present embodiment, it is possible to provide an image forming apparatus capable of downsizing.

[Others]

In the above embodiment, the case where the image forming apparatus includes an intermediate transfer belt having an inverted triangular shape has been described. In order to miniaturize the image forming apparatus, the image forming apparatus may include a transfer belt having a structure folded back by a folding roller. In particular, when the image forming apparatus includes a folding roller between the secondary transfer section and the tension roller, it is necessary to arrange the cleaning apparatus of the transfer belt between the secondary transfer section and the folding roller. Therefore, a difference in height between the cleaning device of the transfer belt and the waste toner conveying unit of the image forming unit is liable to occur. For this reason, it is difficult to increase the capacity of the recovery container mounted on the front side of the apparatus, and the merit of the present invention is increased.

The first conveying unit and the second conveying unit may be made of a screw having a central axis as in the above embodiment, or may be made of a coil shaped member having no central axis. The first conveying unit and the second conveying unit may be formed of a belt-like member.

Although the present invention has been described and illustrated in detail, the disclosed embodiments are made for purposes of illustrated and example only and not limitation. The scope of the present invention being interpreted by terms of the appended claims.

What is claimed is:

1. An image forming apparatus comprising:

an image forming unit that forms an image on a sheet, a sheet conveying unit configured to convey a sheet along a conveying path extending in a substantially horizontal direction vertically below the image forming unit, a recovery container that is provided between the image forming unit and a door of the image forming apparatus and above the conveying path, and that stores waste toner discharged from the image forming unit, the recovery container removable from the image forming apparatus via the door, and one or more cleaning devices disposed at one or more elements of the image forming unit, one or more waste toner conveying pipes that convey the waste toner discharged from the image forming unit to the recovery container;

the one or more waste toner conveying pipes include:

a first waste toner conveying pipe extending from a first cleaning device of the one or more cleaning devices toward the recovery container in a direction toward the door; and a second waste toner conveying pipe extending from a second cleaning device of the one or more cleaning devices toward the recovery container in a direction toward the door, the recovery container comprises a casing including an accommodating unit for storing waste toner, and first and second conveying units for conveying the waste toner in the casing, the casing comprises a first receiving port for receiving the waste toner conveyed by the first waste toner conveying pipe, and a second receiving port provided below the first receiving port, for receiving the waste toner conveyed by the second waste toner conveying pipe, wherein the image forming apparatus further comprises a detection unit for detecting waste toner contained in the casing, at a detection position above the first conveying unit, wherein the first conveying unit equalizes height of upper surface of the waste toner accommodated in the accommodating unit, the second conveying unit conveys the waste toner received from the second receiving port to a position above the detection position, the second conveying unit further includes a transmission unit that transmits rotational force to the blade portion of the second conveying unit, at an upstream end portion in the conveying direction of a rotary shaft of the second conveying unit, the second conveying unit is positioned in a skewed position relative to the first conveying unit, and wherein each of the first conveying unit and the second conveying unit extends linearly from a first end of the respective conveying unit to a second end of the respective conveying unit opposite to the first end.

2. The image forming apparatus according to claim 1, wherein:

the casing further includes a separating unit for separating a portion of the second conveying unit on an upstream side in the conveying direction of the second conveying unit, from the accommodating unit.

3. The image forming apparatus according to claim 2, wherein:

the separating unit exposes a portion of the second conveying unit on a downstream side in the conveying direction of the second conveying unit, to the accommodating unit.

4. The image forming apparatus according to claim 1, wherein:

the second conveying unit conveys the waste toner received from the second receiving port in a direction forming an angle with respect to each of a horizontal direction and a vertical direction, from a lowermost end portion of the casing.

5. The image forming apparatus according to claim 1, wherein:

the second conveying unit includes a spiral blade portion rotatable about a rotation axis.

6. The image forming apparatus according to claim 5, wherein:

the rotation axis of the second conveying unit is offset to a lower surface side of a separating unit, in the separating unit.

7. The image forming apparatus according to claim 1, wherein:

a downstream end portion in a transport direction of the second conveying unit is located above the first conveying unit.

8. The image forming apparatus according to claim 1, wherein:

the first receiving port includes:

a photosensitive member waste toner receiving port for accepting discharge of waste toner discharged from the first cleaning device of the one or more cleaning devices in the image forming unit, and a plurality of developing device waste toner receiving ports for accepting discharge of waste toner discharged from developing devices in the image forming unit, wherein the first conveying unit conveys waste toner in parallel to at least one of an arrangement direction of the plurality of photosensitive member waste toner receiving ports and an arrangement direction of the plurality of developing device waste toner receiving ports.

9. The image forming apparatus according to claim 1, wherein:

the first conveying unit includes a spiral blade portion rotatable about a rotation axis extending in a substantially horizontal direction.

10. The image forming apparatus according to claim 1, further comprising:

a plurality of first rollers arranged substantially in a horizontal direction and stretching a transfer belt in the image forming unit, a second roller disposed below the plurality of first rollers to stretch the transfer belt, the second cleaning device of the one or more cleaning devices is configured for removing waste toner on the transfer belt between any one of the plurality of first rollers and the second roller, wherein the second receiving port accepts the waste toner removed by the second cleaning device.

* * * * *